US009964290B2

(12) United States Patent
Sharrah et al.

(10) Patent No.: US 9,964,290 B2
(45) Date of Patent: May 8, 2018

(54) PORTABLE LIGHT HAVING A CLIP

(71) Applicant: Streamlight, Inc., Eagleville, PA (US)

(72) Inventors: Raymond L. Sharrah, Collegeville, PA (US); W. Ross McLennan, Perkasie, PA (US)

(73) Assignee: Streamlight, Inc., Eagleville, PA (US)

( * ) Notice: Subject to any disclaimer, the term of this patent is extended or adjusted under 35 U.S.C. 154(b) by 817 days.

(21) Appl. No.: 14/448,483

(22) Filed: Jul. 31, 2014

(65) Prior Publication Data

US 2016/0018090 A1 Jan. 21, 2016

Related U.S. Application Data

(63) Continuation of application No. 29/496,898, filed on Jul. 18, 2014, now Pat. No. Des. 765,295.

(51) Int. Cl.

| | |
|---|---|
| ***F21L 4/00*** | (2006.01) |
| ***F21V 21/088*** | (2006.01) |
| ***F21V 23/04*** | (2006.01) |
| ***F21L 4/02*** | (2006.01) |

(52) U.S. Cl.

CPC ..... *F21V 21/0885* (2013.01); *F21L 4/027* (2013.01); *F21V 23/0428* (2013.01)

(58) Field of Classification Search

CPC ... F21L 15/14; F21L 4/02; F21L 4/025; F21L 4/027

USPC ..... 362/171, 184, 190, 191, 205

See application file for complete search history.

(56) References Cited

U.S. PATENT DOCUMENTS

| | | | | |
|---|---|---|---|---|
| 2,385,639 | A * | 9/1945 | Packer | F21L 2/00 362/196 |
| 2,980,889 | A * | 4/1961 | Meissner | F21L 4/00 340/321 |
| 4,803,605 | A * | 2/1989 | Schaller | F21L 4/02 362/184 |
| 5,077,644 | A * | 12/1991 | Schaller | F21L 4/022 362/184 |
| 5,558,430 | A * | 9/1996 | Booty, Jr. | F21L 4/02 362/184 |
| 5,595,436 | A * | 1/1997 | Way, Jr. | F21L 2/00 362/190 |
| D408,090 | S | 4/1999 | Monteleone et al. | |
| 5,993,022 | A * | 11/1999 | Neyer | F21L 4/04 362/199 |

(Continued)

OTHER PUBLICATIONS

Marv Golden Pilot Supplies, "Coast 4 Color Recon Flashlight—Red, Blue, Green, White", © 2017, 3 pgs, http://www.marvgolden.com/coast-4-color-recon-flashlight-red-blue-green-white.html.

(Continued)

*Primary Examiner* — Julie Bannan

(74) *Attorney, Agent, or Firm* — Dann, Dorfman, Herrell & Skillman, P.C.; Clement A. Berard, Esq.

(57) ABSTRACT

A portable light may comprise: a light housing extending from a light head and defining an envelope line extending along a side thereof, the light housing having a recess in the side thereof inward of the envelope line; a light source supported by the light head and energizable to produce light; a switch for selectively energizing the light source; and a clip disposed in the recess of the light housing and configured so that the clip is substantially in the recess and substantially within the envelope line of the light housing.

45 Claims, 9 Drawing Sheets

(56) References Cited

U.S. PATENT DOCUMENTS

| | | | | |
|---|---|---|---|---|
| D427,347 | S | 6/2000 | Sharrah et al. | |
| D427,702 | S | 7/2000 | Sharrah et al. | |
| 6,158,874 | A * | 12/2000 | Brustein | F21L 4/022 362/184 |
| 6,206,541 | B1 * | 3/2001 | Landamia | F21L 4/00 362/184 |
| 6,283,611 | B1 | 9/2001 | Sharrah et al. | |
| D467,376 | S | 12/2002 | Yamamoto | |
| D468,850 | S | 1/2003 | Sharrah et al. | |
| 6,523,972 | B2 * | 2/2003 | Sharrah | F21L 4/025 362/184 |
| D507,067 | S | 7/2005 | Fritz | |
| D565,220 | S | 3/2008 | Galli | |
| 7,401,941 | B2 * | 7/2008 | Teng | F21L 4/027 362/184 |
| D596,329 | S | 7/2009 | Galli | |
| D601,737 | S | 10/2009 | Swan | |
| D678,572 | S | 3/2013 | Zhang | |
| D681,246 | S | 4/2013 | Keeley et al. | |
| D681,858 | S | 5/2013 | Sharrah | |
| 8,506,111 | B2 * | 8/2013 | Woods | F21V 21/0885 362/190 |
| D689,227 | S | 9/2013 | Yeh | |
| D698,961 | S | 2/2014 | Dalton | |
| D709,229 | S | 7/2014 | Wang | |
| 8,807,781 | B2 | 8/2014 | Weber | |
| 8,979,298 | B1 * | 3/2015 | Wang | F21L 4/027 362/184 |
| D726,358 | S | 4/2015 | Young | |
| D728,139 | S | 4/2015 | Wang | |
| 9,194,547 | B2 | 11/2015 | Ancona et al. | |
| 2009/0185368 | A1 * | 7/2009 | Holmes | F21L 4/027 362/184 |

OTHER PUBLICATIONS

MyPilotStore, "Coast TX10 Four Color LED Flashlight", no later than Jun. 18, 2012, printed Jan. 5, 2017, 3 pages, http://www.mypilotstore.com/mypilotstore/sep/8697.

Imago Metrics, "Flashlight Review—Coast/LED Lenser 4 Color Recon Torch", © 2005, 6 pages, http://www.imagometrics.com/FLReviews/LnsrRecon.htm.

Coast Products, Inc., "PX-20 Dual-Color W/R Utility Fixed Beam", © 2015, 3 pages, https://coastportland.com/product/px20/.

Coast Products, Inc., "TX-10 Quad-Color Utility Fixed Beam", © 2015, 2 pages, https://coastportland.com/product/tx10/ © 2015.

Streamlight, Inc., "Product Catalog", Jun. 2001, © 2001, 36 pages.

Streamlight, Inc., "Knucklehead® HAZ-LO®—Spot Model (Alkaline Model)", © 2014, 1 page.

Streamlight, Inc., "Knucklehead® with Clip", © 2014, 1 page.

Streamlight, Inc., "Survivor® LED (Alkaline Model)", © 2014, 1 page.

Streamlight, Inc., "2AA ProPolymer® HAZ-LO®", © 2014, 1 page.

Streamlight, Inc., "3AA ProPolymer® HAZ-LO®", © 2014, 1 page.

Streamlight, Inc., "3C ProPolymer® HAZ-LO®", © 2014, 1 page.

Streamlight, Inc., "3C ProPolymer® LED", © 2014, 1 page.

Streamlight, Inc., "3N ProPolymer® LED", © 2014, 1 page.

Streamlight, Inc., "4AA ProPolymer® LED", © 2014, 1 page.

* cited by examiner

PORTABLE LIGHT HAVING A CLIP

This application claims the benefit of and is a continuation of U.S. patent application Ser. No. 29/496,898 entitled "PORTABLE LIGHT HAVING A CLIP" which was filed on Jul. 18, 2014, and is hereby incorporated herein by reference in it s entirety.

The present invention relates to a portable light and, in particular, to a portable light having a clip.

There are many different configurations of portable lights, of different sizes and shapes, intended for use in a wide variety of applications. Many of these portable lights are for use where it is convenient that the light be supported by an object, and so such lights often have a loop, hook, clip, lanyard or other feature for facilitating the light being attached to and/or supported by an object. Typically such features extend beyond the outline or envelope of the light so that they can attach the light to a desired object.

Features that extend significantly beyond the outline or envelope of a portable light, however, are susceptible to becoming snagged, caught on or otherwise engaging unwanted objects that the light happens to be or come near, e.g., clothing, ropes, cables, wires and the like. This can dislodge the light from the grip of the user or from an object to which the light is attached by the clip. As a result the dislodged light can fall and become damaged or can damage or injure whatever it falls upon or can be rendered inoperative. In any case, when that occurs the light is not in position to direct light to where the user wants light directed and so may cause a danger or risk of injury to the user of the portable light or to others. Such danger and risk may be greater when the light is used in hazardous or dangerous locations.

Applicant believes there may be a need for a portable light that has a clip that does not significantly extend beyond the outline or envelope of the light when not in use.

Accordingly, a portable light may comprise: a light housing extending from a light head and defining an envelope line extending along a side thereof, the light housing having a recess in the side thereof inward of the envelope line; a light source supported by the light head and energizable to produce light; a switch for selectively energizing the light source; and a clip disposed in the recess of the light housing and configured so that the clip is substantially in the recess and substantially within the envelope line of the light housing.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
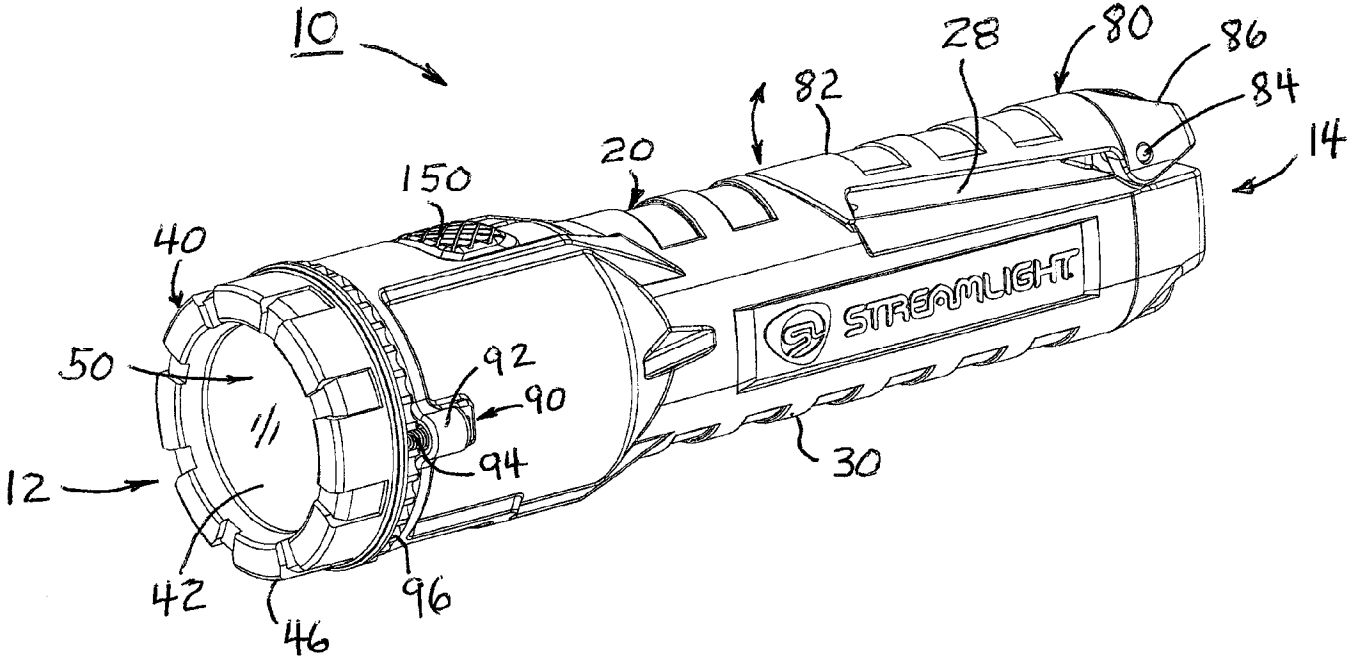
FIG. 1 is a perspective view of an example embodiment of a portable light having a clip viewed from a head end from which light is emitted.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 2:
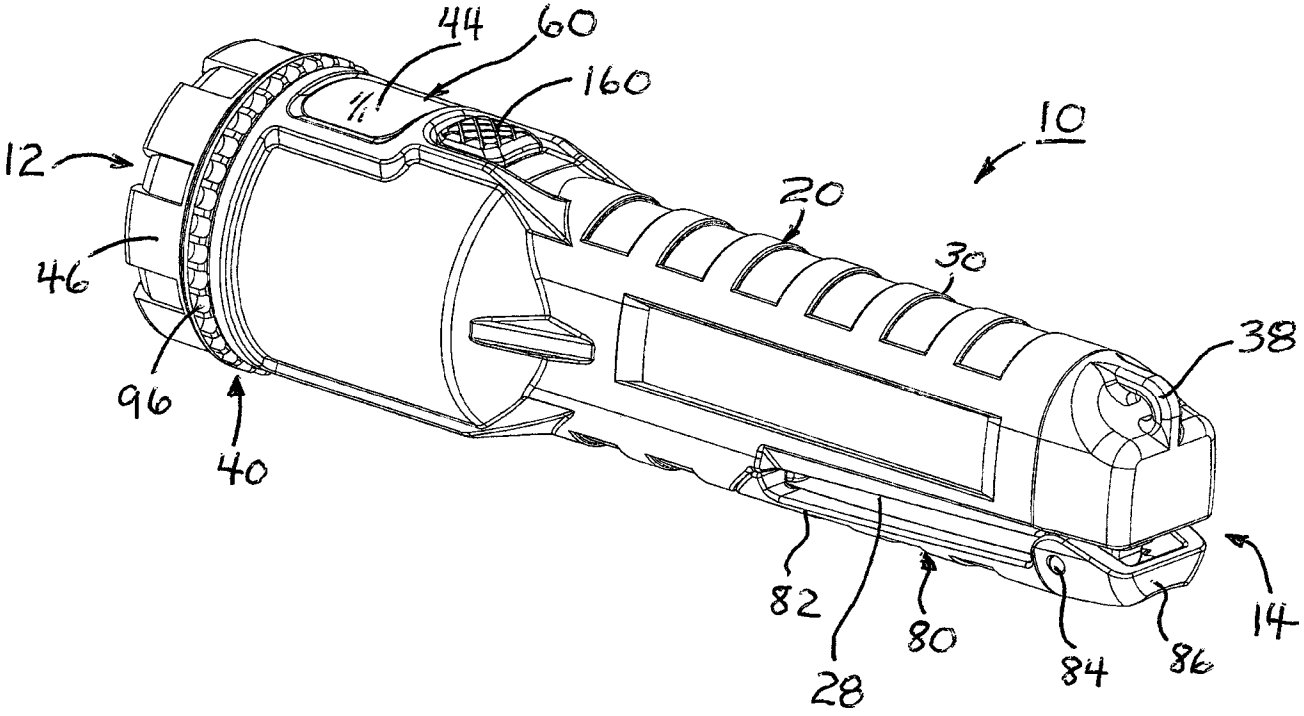
FIG. 2 is another perspective view of an example embodiment of a portable light having a clip viewed from a tail end opposite the head end.

FIG. 1 is a perspective view of an example embodiment of a portable light 10 having a clip 80 viewed from a head end 12 from which light is emitted, and FIG. 2 is another perspective view of an example embodiment of a portable light 10 having a clip 80 viewed from a tail end 14 opposite the head end 12. Portable light 10 has a light body 20 including a light housing 30 to which a light head 40 including one or more light sources 50, 60 is attached at a forward or head end 12 of portable light 10. Light 10 and light housing 20 also have a rear or tail end 14 opposite the head end 12. One or more switch actuators 150, 160 may be provided for selectively energizing the one or more light sources 50, 60 to produce light.

In one example embodiment, portable light 10 has a first light source 50 in head 40 that produces light which is directed substantially axially forward along the longitudinal axis of light 10. Light from light source 50 is emitted axially forwardly through lens 42 of head 40 at head end 12. Additional and optionally, as in the illustrated example embodiment, light 10 also has a second light source 60 that produces light which is directed to the side, e.g., at an angle to the longitudinal axis of light 10, through lens 44 of head 40 which preferably is near to head end 12.

In one preferred arrangement, the light projected forwardly may have a relatively narrow beam angle, e.g., may be a spot beam, and the light projected to the side may have a relatively wider beam angle, e.g., may be a flood beam. The beam directed forward typically is substantially centered on the forward direction of the longitudinal axial axis of light 10 and the light directed to the side typically is centered on an axis that is rotated between about 60° and about more than 90° to the side from the forward direction of the longitudinal axial axis of light 10. In one example portable light 10, a flood beam is directed to the side, e.g., downward, at about 90° off a forwardly directed longitudinal axis.

In the usual orientation in which example portable light 10 would be used, e.g., with the forwardly directed beam directed substantially horizontally forward, e.g., to illuminate areas and objects that are in front of the user, the actuator 150 would be at the top of light 10, and lens 44 and actuator 160 would be downward facing so as to illuminate the surface and objects that are immediately in front of the user. In one preferred embodiment, each of light sources 50, 60 are independently actuatable and controllable by the user so that either one or both of light sources 50, 60 may be selectively operated to provide a forwardly directed spot beam, a sideways (e.g., usually downwardly) directed flood beam, or both.

In one example embodiment, switch actuator 150 which is on the top of head 40 of light 10 when light 10 is used in its usual orientation may be utilized to control operation of light source 50 and the forwardly directed light beam it produces, and switch actuator 160 which is on the bottom of head 40 of light 10 adjacent side lens 44 when light 10 is used in its usual orientation may be utilized to control operation of light source 60 and the sideways directed light beam it produces. Alternatively, and optionally, light 10 may include a controller or other electrical circuitry that is responsive to switch actuators 150 and/or 160 so that either or both switch actuators 150, 160 may be utilized for controlling either or both of light sources 50, 60 and the light selectively produced thereby.

Portable light 10 includes a clip 80 that is pivotably mounted 84 in a recess 28 of light housing 30 near the rearward end 14 thereof. Clip 80 has an elongated member 82 extending forward of the pivot 84 and has a shorter member 86 rearward of pivot 84. Clip 80 is preferably biased 88, e.g., by a spring 88, to pivot towards light housing 30 thereby to either urge the remote end of elongated clip member 82 to bear against light housing 30 (e.g., at the forward end of recess 28 as illustrated) or against an object that is between elongated clip member 82 and light housing 30. Pressing on shorter member 86 causes clip 80 to rotate on pivot 84 such that the remote (forward) end of elongated clip member 82 moves away from light body 20, 30 thereby to create a gap between clip member 82 and light housing 30 where an object to which light 10 is to be attached, e.g., clipped, may be placed. The pivotability of clip 80 is indicated by a double-ended arrow.

Where portable light 10 is intended for use in hazardous environments, light 10 may include a lock arrangement 90 that prevents the removal of lens ring 46, e.g., to gain access the interior of light 10, e.g., to install and/or replace batteries therein, without the use of a tool. Lens ring 46 preferably includes a plurality of raised ridges 96 disposed circumferentially around the outer circumference of lens ring 46, thereby to define a plurality of recesses 96 around the periphery of lens ring 46.

Lock arrangement 90 may include, e.g., a lock support 92 at the forward end of housing 30 that includes a threaded axial opening in which is disposed a threaded lock member 94. When lock member 94 is rotated by a tool in one direction it advances axially forward to engage one of the plural recesses 96 thereby to lock lens ring 46 in its then present position, and when lock member 94 is rotated by a tool in an opposite direction it advances axially rearward to disengage from the plural recesses 96 thereby to enable lens ring 46 to be rotated on housing 30 from its then present position, e.g., to be removed therefrom.

A loop or opening 38 may be provided at the rear of light housing 30, e.g., for receiving a ring, e.g., a split ring, or a lanyard as may be desired, by a user of light 10. Loop 28 may also be utilized to hang light 10 on a pin or hook.

Figure 3:
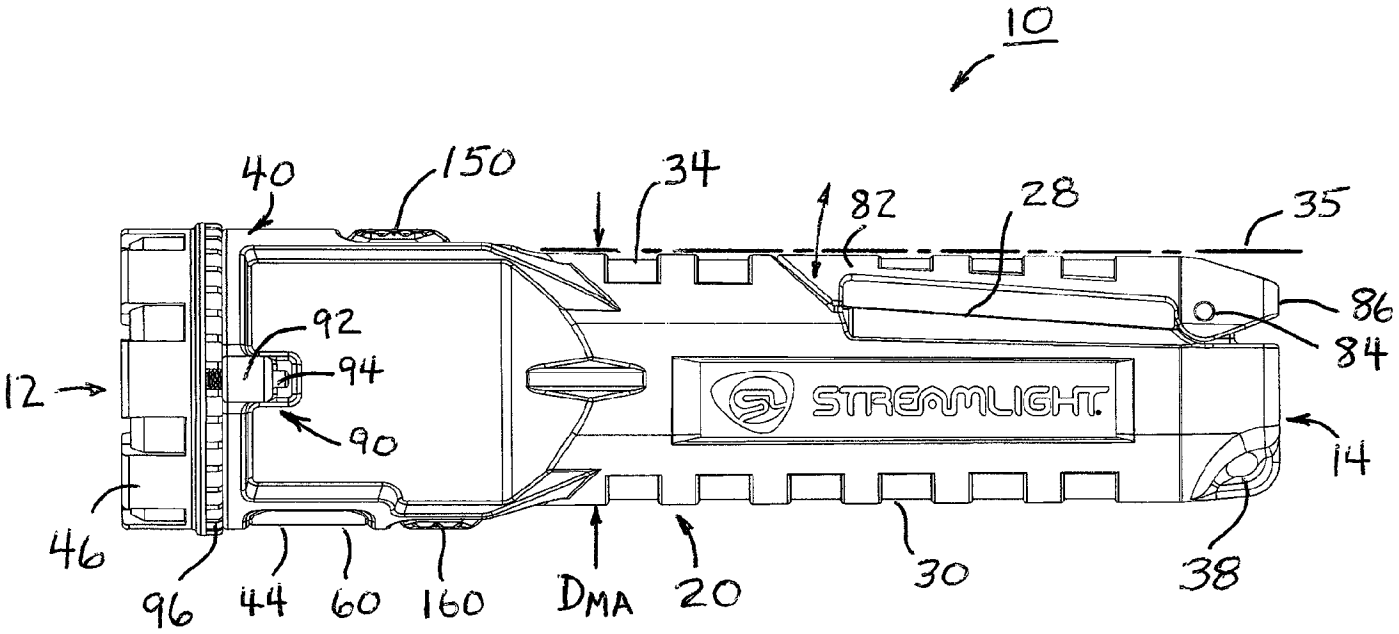
FIG. 3 is a side view of a first and broader side of the example portable light shown in FIGS. 1 and 2.
Figure 4:
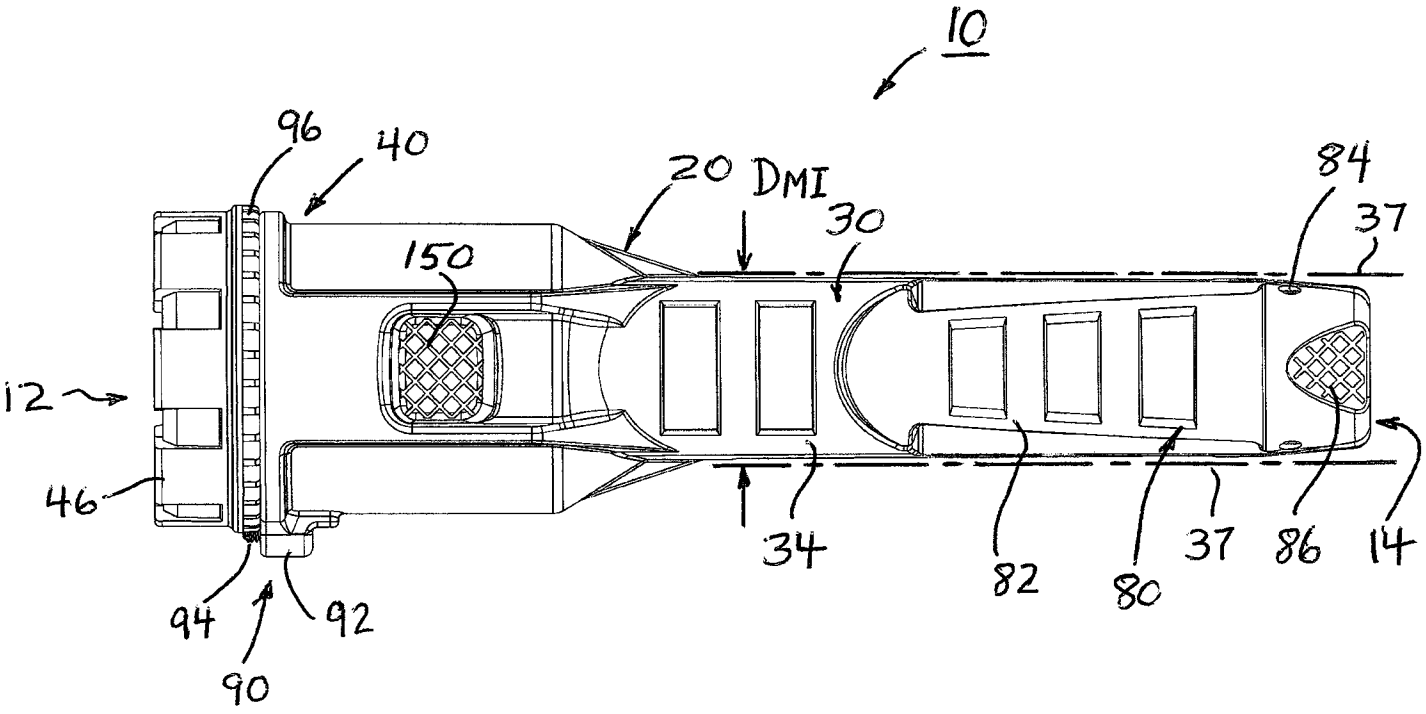
FIG. 4 is a side view of a second and narrower side thereof wherein the clip is visible.
Figure 5:
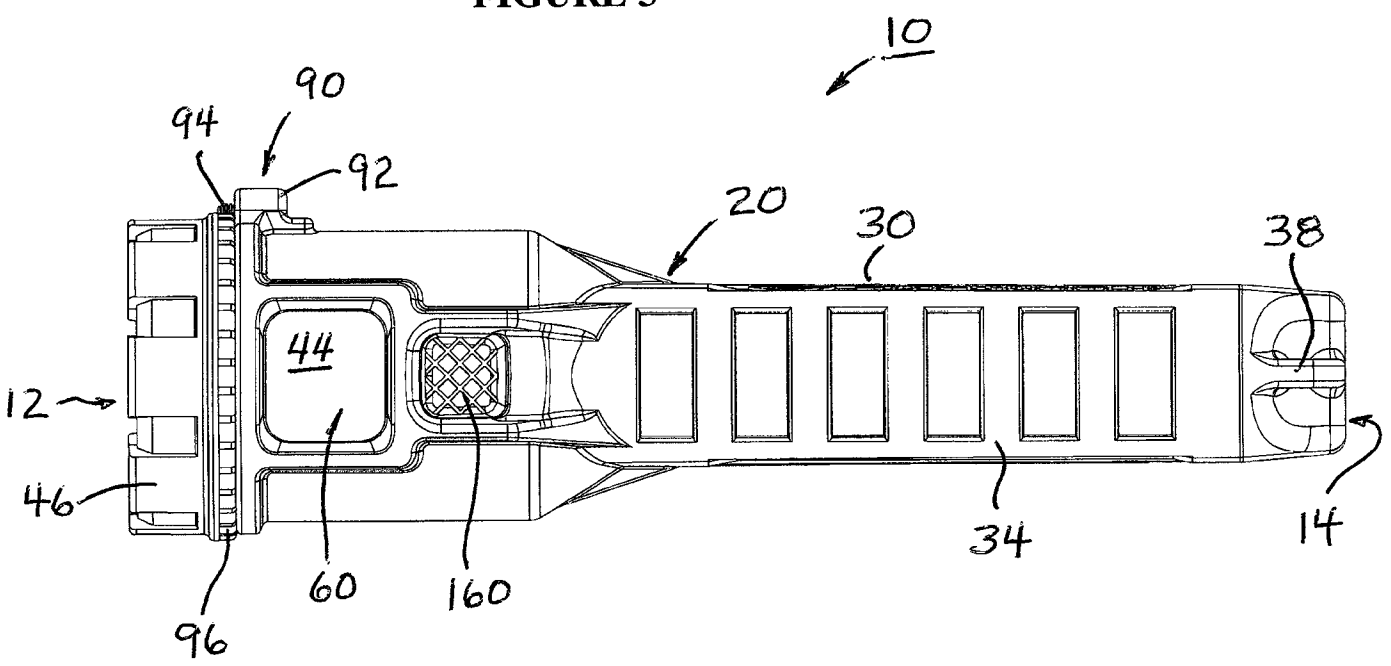
FIG. 5 is a side view of a fourth and narrower side thereof opposite the clip which includes a side facing lens from which light is emitted.
Figure 6:
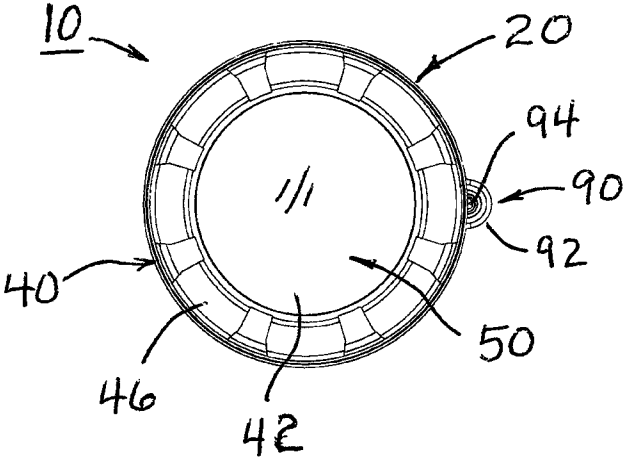
FIG. 6 is an end view of a first end thereof from which light is emitted.
Figure 7:
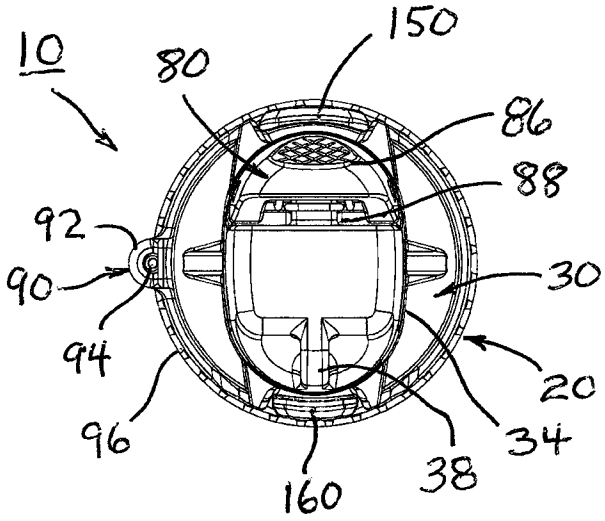
FIG. 7 is a view of a second end thereof opposite to the first end thereof.

FIG. 3 is a side view of a first and broader side of the example portable light 10 shown in FIGS. 1 and 2; FIG. 4 is a side view of a second and narrower side thereof wherein the clip 80 is visible; FIG. 5 is a side view of a fourth and narrower side thereof opposite the clip 80 which includes a side facing lens 44 from which light is emitted; FIG. 6 is an end view of a first end 12 thereof from which light is emitted via lens 42; and FIG. 7 is an end view of a second end 14 thereof opposite to the first end 12 thereof. A third and also broader side of the example portable light 10, opposite to the first broader side thereof, is substantially a mirror image of the first side thereof, but without lock mechanism 90.

Light housing 20 is substantially cylindrical at its forward or head end 12 and has a substantially oval or elliptical cross-sectional shape along its barrel 34, e.g., from its cylindrical head 40 to its rearward or tail end 14. The oval or elliptical cross-sectional shape of barrel 34 defines a major (or larger) dimension $D_{MA}$ and a minor (or smaller) dimension $D_{MI}$ as indicated in FIGS. 3 and 4. It is noted that light housing 20 may have other shapes and sizes, e.g., head end 30 thereof may be oval or polygonal, e.g., hexagonal or octagonal, and may be larger or smaller or the same size as barrel 34. Similarly, barrel 34 of light housing 20 may have other shapes and sizes, e.g., may be cylindrical, oval or polygonal, e.g., hexagonal or octagonal, and may be larger or smaller or the same size as head 40. It is neither necessary nor preferred that head 40 and barrel 34 have different cross-sectional shapes and/or sizes or that they have the same cross-sectional shape and/or size.

The outer surface of the forward end of barrel 34, at what could be referred to as being the top of light 10, defines a line 35, e.g., at the major dimension $D_{MA}$ thereof, that can be extended rearwardly to end 14 and generally following the envelope or outline thereof. Clip 80 is preferably and substantially, if not completely, within recess 28 and between line 35 and housing 30. If the cross-sectional shape of barrel 34 is symmetrical about the central axis of light 10, then dimensions $D_{MA}$ and $D_{MI}$ may be substantially the same.

Similarly, the outer surface of the forward end of barrel 34, at what could be referred to as being the sides of light 10, defines lines 37, e.g., at the minor dimension $D_{MI}$ thereof, that can be extended rearwardly to end 14 and generally following the envelope or outline thereof. Clip 80 is preferably and substantially, if not completely, within recess 28 and between lines 37 and housing 30.

In the illustrated example embodiment the cross-section of barrel 34 is substantially the same over a substantial part of its length, and lines 35, 37 can be substantially parallel to each other and to the central longitudinal axis of light 10. From a practical standpoint, housing 30 is slightly narrower at rearward end 14, e.g., to provide draft for molding housing 30, and so lines 35, 37 are not truly parallel, but converge slightly. It is not necessary that lines 35, 37 be parallel or substantially parallel to each other or to the center light of light 10, and, e.g., light housing 30 and the envelope thereof could be substantially narrower at rearward end 14 than at the forward end of barrel 34 thereof.

Further, it is not necessary that clip 80 strictly be entirely within line 35 and/or within lines 37, only that clip 80 not extend substantially beyond the envelope or outline of light housing 30 sufficiently or in a manner such that it might easily catch on or snag external objects. For example, a clip 80 extending beyond lines 35 and/or 37 might be shaped where it rests against barrel 34 and recess 28 thereof at a relatively small angle or edge, e.g., as does clip 80 in the illustrated example embodiment, thereby to not present any substantial edge or raised feature, particularly along the sides of light 10, that could easily snag or catch on an external object.

As is visible in FIG. 6, barrel 34 of light housing 30 of the illustrated embodiment is seen to have a substantially oval or elliptical cross-sectional shape and clip 80 is seen to be substantially within that oval or elliptical outline, as is preferred, but is not strictly necessary.

Figure 8:
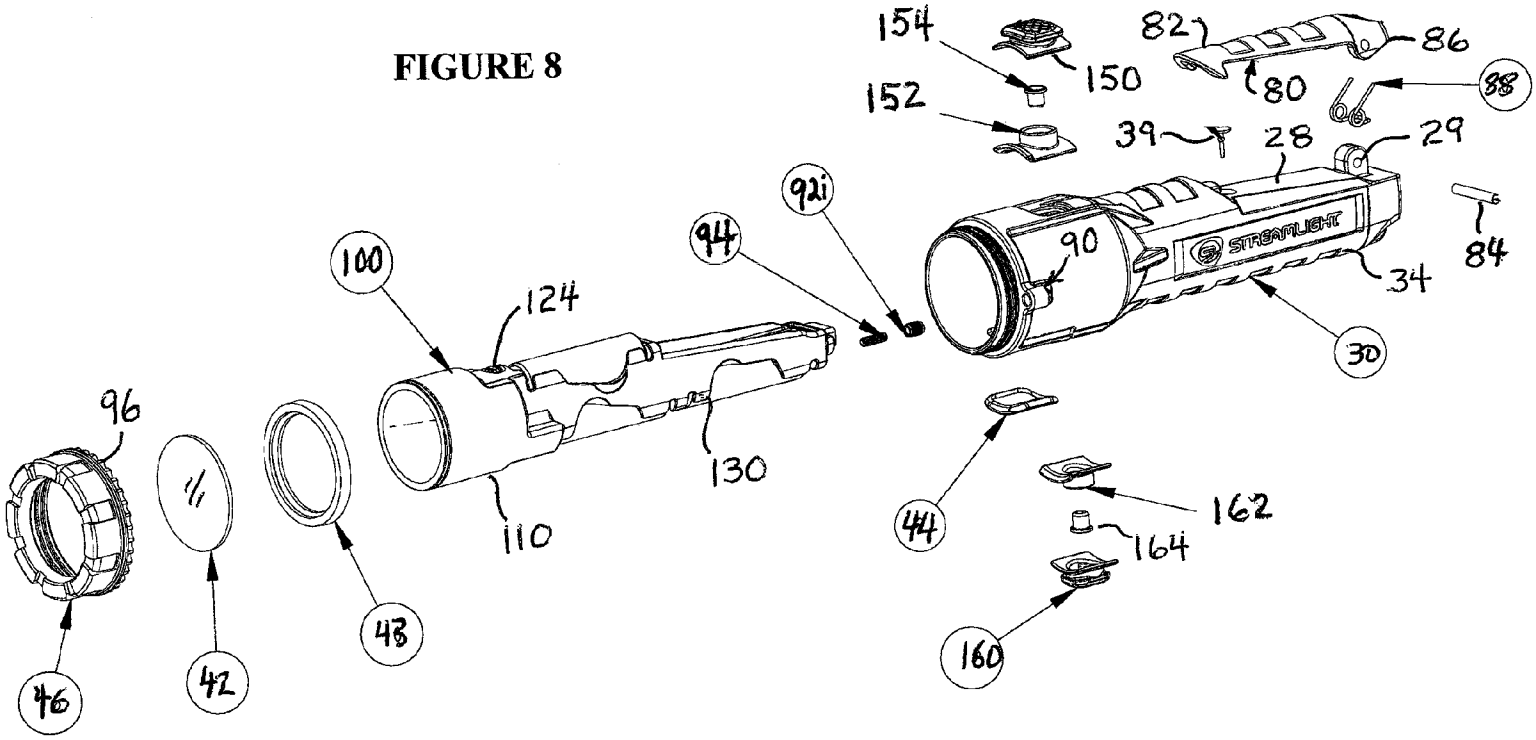
FIG. 8 is an exploded view of the example portable light.
Figure 9:
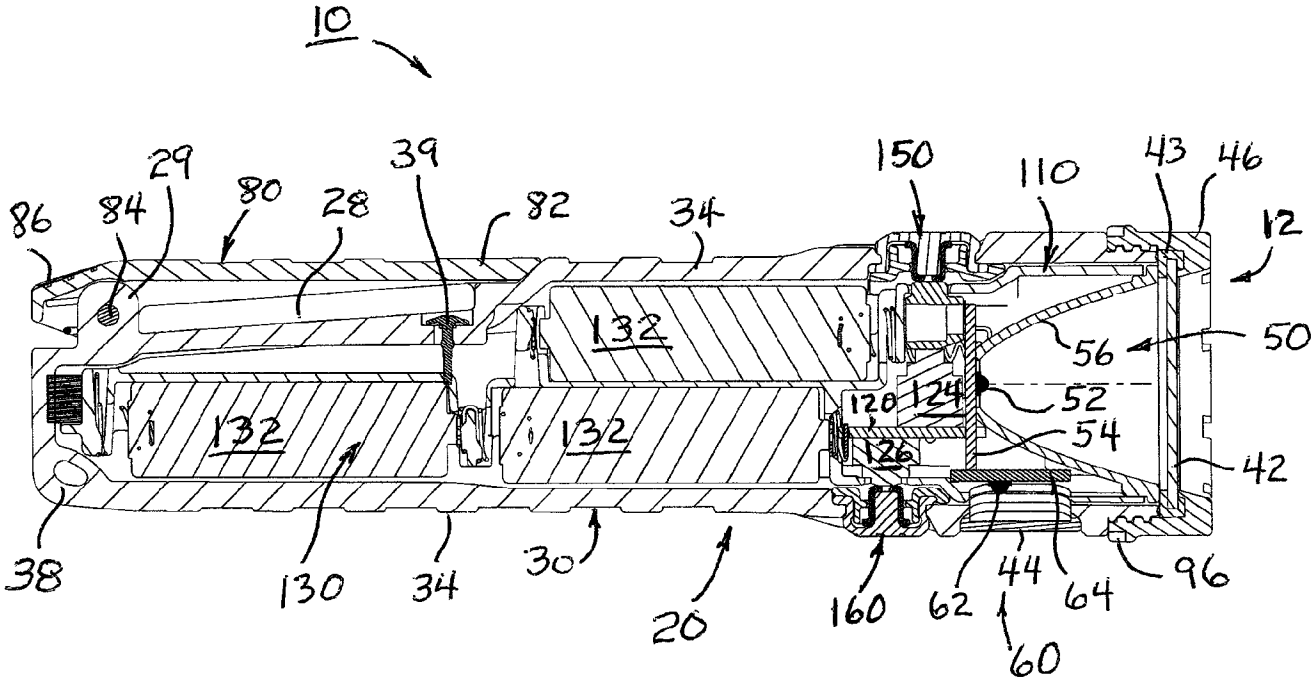
FIG. 9 is a cross-sectional view of the example portable light taken in a plane that bisects the light body longitudinally, including the clip, an internal electrical power source and other internal elements of the portable light.

FIG. 8 is an exploded view of the example portable light 10; and FIG. 9 is a cross-sectional view thereof taken in a plane that bisects the light body 20 longitudinally, including the clip 80, an internal assembly 100 including an electrical power source 130 and other internal elements of the portable light 10. Structure and features described above are not repeated here. Light housing 30 is seen to have a threaded forward end (with external threads) onto which lens ring 46, which has internal threads, threadingly attaches, to hold lens 42 against the forward end of light housing 30. Optionally, but preferably, a circular seal 43 is disposed between the rear surface of lens 42 and the forward end of housing 30. Seal 43 may be an O-ring or may be a shaped circular seal having, e.g., an annular recess for receiving the periphery of lens 42 as illustrated.

At the rear end 14 of housing 30, extending from recess 28, is a base 29 which has a transverse opening for receiving a pivot pin 84 of clip 80. Biasing member 88, e.g., a spring 88, has one of more loops through which pivot pin 84 passes with one loop of spring 88 on each side of base 29. A link of spring 88 between the two loops bears against housing 30 and two prongs thereof bear against the rearward extension 86 of clip 80, thereby to bias rearward extension 86 away from housing 30 and due to the pivot action of pin 84, to bias the distal end of elongated clip member 82 to bear against the forward end of recess 28 of housing 30, whereby clip 82 can clip an object between its end 82 and housing 30.

Switch actuator 150 includes an actuator boot 150 and a retainer 152 to clamp boot 150 adjacent to housing 30, and preferably provide a seal thereat. Switch actuator 150 also includes a hollow cylindrical support or plunger 154 for transmitting pressure applied to actuator boot 150 inward to an electrical switch 124 which is mounted on a first side of printed circuit board 120 within switch module 110 of internal assembly 100.

Switch actuator 160 includes an actuator boot 160 and a retainer 162 to clamp boot 160 adjacent to housing 30, and preferably provide a seal thereat. Switch actuator 160 also includes a hollow cylindrical support or plunger 164 for transmitting pressure applied to actuator boot 160 inward to an electrical switch 126 which is mounted on a second side of printed circuit board 120 within switch module 110 of internal assembly 100.

It is noted that actuator 150 is located on the same side of light 10 as is clip 80, and that actuator 160 is located on the side of light 10 that is opposite to clip 80. Thus, when light 10 is clipped to an object, e.g., by being clipped by clip 80 to an object, e.g., to a person's belt or clothing or to a tool carrier, actuator 160 is exposed and may easily be actuated, e.g., by being pressed towards the object or person, to illuminate the transversely directed light source 60 will provide a beam of light directed outwardly away from the object or person.

Internal assembly 100 is shaped and sized to be inserted into light housing 30 from the opening at the cylindrical forward end thereof. Assembly 100 includes a cylindrical switch module 110 at the forward end thereof and a battery holder 130 extending rearwardly therefrom. Battery holder 130 tapers in transverse dimension, e.g., top to bottom, and being narrower at the rearward end thereof, thereby to fit within the narrower rearward end of barrel 34 of housing 30.

Switch module 110 includes an electrical circuit for controlling operation of light sources 50, 60 and light sources 50, 60. The electrical circuit includes two switches 124, 126 that are actuatable via switch actuators 150, 160, respectively, for selectively energizing one or both of light sources 50, 60 in accordance with the electrical circuit and controls of light 10. Switches 124, 126 are supported by printed circuit board 120.

Light source 50 includes a light emitting diode (LED) 52 mounted on a transversely positioned circuit board 54 adjacent an opening at the narrow end of reflector 56. Reflector 56 has a curved light reflecting surface, e.g., a parabolic or other shaped surface, and opens to a wider end adjacent to lens 42, thereby to form and direct light from LED 52 forwardly through lens 42 and in a general forward direction substantially along the central longitudinal axis of portable light 10. Preferably, reflector 56 forms light produced by LED 52 into a substantially relatively narrow or spot beam.

Light source 60 includes a light emitting diode (LED) 62 mounted on an axially positioned circuit board 64 adjacent an opening in which side lens 44 is disposed. Light source 60 does not have a reflector so that the light produced by LED 62 opens to a wider beam, thereby to form and direct light from LED 62 through lens 44 and in a general sideways or radial direction from portable light 10. Preferably, LED 62 and lens 44 forms light produced by LED 62 into a substantially relatively wider or flood beam.

Battery holder 130 includes a carrier that receives and supports a source of electrical power 132, e.g., a carrier preferably having one or more receptacles for receiving one or more batteries 132. Receptacles for batteries 132 are preferably configured to receive plural batteries 132 side by side at the end thereof close to switch module 110 and a lesser number of batteries side by side at the distal end thereof.

In the illustrated embodiment, battery holder or carrier 130 supports a single battery 132 at the distal end thereof and supports two batteries 132 in side by side arrangement in the forward end thereof. This configuration provides for three batteries 132 which can be electrically connected in series by electrical conductors of carrier 130 to provide sufficient voltage for electrically powering first and second light emitting diode (LED) light sources 52, 62. Two batteries 132 are disposed side by side within the oval or elliptically shaped cross-section of the forward end of barrel 34 and the single battery 132 fits within the narrowed, e.g., approximately a partial oval cross-sectional, shape of the rearward end of barrel 34. As a result, barrel 34 of housing 30 can be configured to provide a sufficiently large recess 28 at the rearward end 14 of light 10 to receive a clip 80 of sufficient size to support light 10, with clip 80 not extending beyond the envelope of light housing 30 sufficiently to become caught on of snagged on an external object.

Alternatively, battery holder 130 may be considered as supporting two batteries 132 in end to end arrangement in the portion thereof, e.g., a lower portion, that is disposed to extend into the narrower rearward end of housing 30, e.g., adjacent to recess 28 and clip 80, and to support a single battery 132 in the forward upper part thereof that is forward of recess 28 and clip 80 and side by side with the forward battery 132 of the two batteries 132 that are in end to end arrangement.

Housing 30 also has an opening, e.g., an opening in the wall between recess 28 and the interior cavity of barrel 34, in which resides a resilient plug 39 that serves as a valve to, e.g., relieve any pressure that may occur within portable light 10.

Internal assembly 100 may have a closed-cell foam pad or other resilient member at the distal end of battery holder 130 thereof for absorbing shock and/or adjusting for tolerances and/or gaps. Housing 30 may have a threaded insert in the lock support 92 thereof into which is threaded a set screw 94 that serves as a lock member 94 for engaging the plural recesses 96 around the periphery of lens ring 46. Switch module and battery holder 130 typically include metal clips, springs and other conductors for providing electrically conductive paths among LEDs 52, 62, batteries 132, and circuit board 120 as may be needed for operating portable light 10, and circuit board 120 typically includes in addition to switches 124, 126, various resistors and other electronic parts as may be needed for operating LEDs 52, 62 in a desired manner. Typically, LEDs 52, 62 each may be controlled by switches 124, 126 to operate in at least continuous ON and OFF states, and preferably at least in a momentary ON state.

In one typical example embodiment, portable light 10 is about 7 inches (about 17.8 cm) in length, head 40 thereof is about 1.8 inches (about 4.6 cm) in diameter, and dimensions $D_{MA}$ and $D_{MI}$ of barrel 34 are about 1.5 inches (about 3.8 cm) and about 1.05 inches (about 2.7 cm), respectively.

By way of example, housing 30, lens ring 46, clip 80 and internal assembly 100 including switch module 110 and battery holder 130, are preferably molded, and may be of nylon, engineered nylon, ABS plastic, polycarbonate, or any other suitable plastic or other moldable material. Switch actuator members 150, 152, 160, 164 and valve 39 may be of rubber, synthetic rubber, silicone, or any other suitable elastomeric or resilient material. Lenses 42, 44 may be of glass, polycarbonate, or any other optically transparent material. Batteries 132 may be of any suitable size and type, and in one preferred embodiment, three size AA alkaline or lithium batteries 132 are employed.

A portable light 10 may comprise: a light body 20 including a light head 40 and a light housing 30 extending from the light head 40, the light housing 30 defining an envelope line extending along a side thereof away from the light head 40 along a side of the light housing 30, the light housing 30 having a recess 28 in the side thereof inward of the envelope line; a light source 50, 60 supported by the light head 40 and energizable to produce light; a switch 124, 126, 150, 160 for selectively energizing the light source 50, 60 to produce light; and a clip 80 disposed in the recess 28 of the light housing 30, wherein the shape and size of the recess 28 and the shape and size of the clip 80 are configured so that the clip 80 is substantially in the recess 28 and substantially within the envelope line of the light housing 30, whereby the clip 80 does not extend substantially beyond the envelope of the portable light 10 where it could catch on or snag an external object. The light housing 30 may have an internal cavity for receiving plural sources of electrical power 132, wherein the cavity is configured to receive fewer of the plural sources of electrical power 132 in side by side arrangement in a location adjacent to the recess 28 than at another location in the cavity. The clip 80 may be pivotable relative to the light housing 30; or the clip 80 may be biased to pivot towards the light housing 30; or the clip 80 may be proximate an end of the light housing 30 distal the light head 40; or the clip 80 may be pivotable relative to the light housing 30 and may be biased to pivot towards the light housing 30; or the clip 80 may be proximate an end of the light housing 30 distal the light head 40, may be pivotable relative to the light housing 30 and may be biased to pivot towards the light housing 30. The light housing 30 may include a pivot base 29 extending from the recess 28 thereof, the pivot base 29 supporting a pivot pin 84 on which the clip 80 pivots. The portable light 10 may further include a biasing member 88 biasing the clip 80 to pivot on the pivot pin 84 towards the light housing 30. The portable light 10 may further comprise: an internal assembly 100 including a battery holder 130 extending into the cavity of the light housing 30 for supporting a plurality of sources of electrical power 132, wherein the battery holder 130 supports fewer of the plural sources of electrical power 132 in side by side arrangement in a location adjacent to the recess 28 than at another location in the cavity. The light housing 30 may include one or more switch actuators 150, 160, and the portable light 10 may further comprise an internal assembly 100 including a switch module 110 interior the light housing 30, the switch module 110 including one or more electrical switches 124, 126 positioned adjacent the one or more switch actuators 150, 160 for being actuated thereby. The light source 50, 60 may include a first light source 50, supported in the light head 40 of the light body 20, the first light source 50, 60 including a reflector 56 for directing light produced by the first light source 50, outwardly substantially along a central longitudinal axis of the light body 20. The portable light 10 may further comprise a switch actuator 150, 160 on the light body 20 between the light head 40 thereof and the clip 80, wherein the switch actuator 150, 160 actuates an electrical switch 124, 126, for selectively energizing the first light source 50, 60. The portable light 10 wherein the light source 50, 60 may include a second light source 60 supported in the light head 40 of the light body 20, the second light source 60 directing light outwardly substantially transversely to the central longitudinal axis of the light body 20. The portable light 10 may further comprise a switch actuator 160 adjacent a lens on a side of the light body 20 through which light from the second light source 60 is directed, wherein the switch actuator 160 actuates an electrical switch 124, 126, for selectively energizing the second light source 60. The first light source 50, may produce a spot beam and the second light source 60 may produce a flood beam.

A portable light 10 may comprise: a light body 20 including a light head 40 and a light housing 30 extending from the light head 40, the light housing 30 defining an envelope line extending along a side thereof away from the light head 40 along a side of the light housing 30, the light housing 30 having a recess 28 in the side proximate an end thereof distal the light head 40 and inward of the envelope line; a light source 50, 60 supported by the light head 40 and energizable to produce light; a switch 124, 126, 150, 160 for selectively energizing the light source 50, 60 to produce light; and a clip 80 disposed in the recess 28 of the light housing 30, wherein the shape and size of the recess 28 and the shape and size of the clip 80 are configured so that the clip 80 is substantially in the recess 28 and substantially within the envelope line of the light housing 30, whereby the clip 80 does not extend substantially beyond the envelope of the portable light 10 where it could catch on or snag an external object. The light housing 30 may have an internal cavity for receiving plural sources of electrical power 132, wherein the cavity may be configured to receive fewer of the plural sources of electrical power 132 in side by side arrangement in a location adjacent to the recess 28 than at another location in the cavity. The clip 80 may be pivotable relative to the light housing 30; or the clip 80 may be biased to pivot towards the light housing 30; or the clip 80 may be pivotable relative to the light housing 30 and may be biased to pivot towards the light housing 30. The light housing 30 may include a pivot base 29 extending from the recess 28 thereof, the pivot base 29 supporting a pivot pin 84 on which the clip 80 pivots. The portable light 10 may further include a biasing member 88 biasing the clip 80 to pivot on the pivot pin 84 towards the light housing 30. The portable light 10 may further comprise: an internal assembly 100 including a battery holder 130 extending into the cavity of the light housing 30 for supporting a plurality of sources of electrical power 132, wherein the battery holder 130 supports fewer of the plural sources of electrical power 132 in side by side arrangement in a location adjacent to the recess 28 than at another location in the cavity. The light housing 30 may include one or more switch actuators 150, 160, and the portable light 10 may further comprise an internal assembly 100 including a switch module 110 interior the light housing 30, the switch module 110 including one or more electrical switches 124, 126 positioned adjacent the one or more switch actuators 150, 160 for being actuated thereby. The light source 50, 60 may include a first light source 50, supported in the light head 40 of the light body 20, the first light source 50, including a reflector 56 for directing light produced by the first light source 50, outwardly substantially along a central longitudinal axis of the light body 20. The portable light 10 of claim 8 may further comprise a switch actuator 150, 160 on the light body 20 between the light head 40 thereof and the clip 80, wherein the switch actuator 150, 160 actuates an electrical switch 124, 126, for selectively energizing the first light source 50, 60. The light source 50, 60 may include a second light source 60 supported in the light head 40 of the light body 20, the second light source 60 directing light outwardly substantially transversely to the central longitudinal axis of the light body 20. The portable light 10 may further comprise a switch actuator 160 adjacent a lens 44 on a side of the light body 20 through which light from the second light source 60 may be directed, wherein the switch actuator 150, 160 actuates an electrical switch 124, 126, for selectively energizing the second light source 60. The first light source 50, may produce a spot beam and the second light source 60 may produce a flood beam.

A portable light 10 may comprise: a light body 20 including a light head 40 and a light housing 30 extending from the light head 40, the light housing 30 defining an envelope line extending along a side thereof away from the light head 40 along a side of the light housing 30, the light housing 30 having an internal cavity for receiving plural sources of electrical power 132, wherein the cavity is configured to receive fewer of the plural sources of electrical power 132 in side by side arrangement in a first location in the cavity than at another location in the cavity; the light housing 30 having a recess 28 in the side thereof proximate the first location in the cavity thereof and inward of the envelope line; a light source 50, 60 supported by the light head 40 and energizable to produce light; a switch 124, 126, 150, 160 for selectively energizing the light source 50, 60 to produce light; and a clip 80 disposed in the recess 28 of the light housing 30, wherein the shape and size of the recess 28 and the shape and size of the clip 80 are configured so that the clip 80 is substantially in the recess 28 and substantially within the envelope line of the light housing 30, whereby the clip 80 does not extend substantially beyond the envelope of the portable light 10 where it could catch on or snag an external object. The clip 80 may be pivotable relative to the light housing 30; or the clip 80 may be biased to pivot towards the light housing 30; or the clip 80 may be proximate an end of the light housing 30 distal the light head 40; or the clip 80 may be pivotable relative to the light housing 30 and may be biased to pivot towards the light housing 30; or the clip 80 may be proximate an end of the light housing 30 distal the light head 40, may be pivotable relative to the light housing 30 and may be biased to pivot towards the light housing 30. The light housing 30 may include a pivot base 29 extending from the recess 28 thereof, the pivot base 29 supporting a pivot pin 84 on which the clip 80 pivots. The portable light 10 may further include a biasing member 88 biasing the clip 80 to pivot on the pivot pin 84 towards the light housing 30. The portable light 10 may further comprise: an internal assembly 100 including a battery holder 130 extending into the cavity of the light housing 30 for supporting a plurality of sources of electrical power 132, wherein the battery holder 130 supports fewer of the plural sources of electrical power 132 in side by side arrangement in the first location adjacent to the recess 28. The light housing 30 may include one or more switch actuators 150, 160, and the portable light 10 may further comprise an internal assembly 100 including a switch module 110 interior the light housing 30, the switch module 110 including one or more electrical switches 124, 126 positioned adjacent the one or more switch actuators 150, 160 for being actuated thereby. The light source 50, 60 may include a first light source 50, supported in the light head 40 of the light body 20, the first light source 50, including a reflector 56 for directing light produced by the first light source 50, 60 outwardly substantially along a central longitudinal axis of the light body 20. The portable light 10 may further comprise a switch actuator 150, 160 on the light body 20 between the light head 40 thereof and the clip 80, wherein the switch actuator 150, 160 actuates an electrical switch 124, 126, for selectively energizing the first light source 50, 60. The light source 50, 60 may include a second light source 60 supported in the light head 40 of the light body 20, the second light source 60 directing light outwardly substantially transversely to the central longitudinal axis of the light body 20. The portable light 10 may further comprise a switch actuator 160 adjacent a lens 44 on a side of the light body 20 through which light from the second light source 60 is directed, wherein the switch actuator 160 actuates an electrical switch 124, 126, for selectively energizing the second light source 50, 60. The first light source 50 may produce a spot beam and the second light source 60 may produce a flood beam.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electro-chemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a three or six cell lead acid battery typically producing about 6 volts or about 12 volts, a three cell Ni—Cd battery typically producing about 3.6 volts, a four cell NiMH battery typically producing about 4.8 volts, a five cell NiMH battery producing about 6 volts, a Li-Ion battery typically producing about 3.5 volts, or a two-cell Li-Ion battery typically producing about 7 volts, it being noted that the voltages produced thereby will be higher when approaching full charge and will be lower in discharge, particularly when providing higher current and when reaching a low level of charge, e.g., becoming discharged.

While the present invention has been described in terms of the foregoing example embodiments, variations within the scope and spirit of the present invention as defined by the claims following will be apparent to those skilled in the art. For example, clip 80 may be configured to be entirely within the outline or envelope of portable light 10 or to be substantially therein. The outline or envelope of a light may be defined by one or more of lines 35, 37 and need not be defined by all of those lines.

Clip 80 is illustrated in the example embodiment as being located generally rearward on light body 20 in recess 28 thereof, however, clip 80 may be located at any convenient or desired location on light body 20. Clip 80 is by location, by placement, by size, and/or shape, configured so as to be within an envelope defined by the light housing and thus not easily snag or catch on external objects.

Preferably, light body 20 may have various raised and/or recessed features, or may have smooth surfaces. In the illustrated light 10, various substantially rectangular recesses are provided for aesthetic purposes and/or for tactile gripping, and may be utilized for receiving various branding and marking information therein.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

Each of the U.S. Provisional Applications, U.S. Patent Applications, and/or U.S. Patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body including a light head and a light housing extending from said light head, said light housing defining an envelope line extending along a side thereof away from said light head along the side of said light housing, said light housing having a recess in the side thereof inward of the envelope line;

a light source supported by said light head and energizable to produce light;

a switch for selectively energizing said light source to produce light; and a clip pivotably disposed in the recess of said light housing, wherein said clip is pivotable on a pivot that is disposed on a pivot base extending from the recess of said light housing and is biased by a biasing member to move about the pivot on the pivot base into the recess of said light housing, and wherein the shape and size of the recess and the shape and size of said clip are configured so that said clip is in the recess and within the envelope line of said light housing, whereby said clip does not extend beyond the envelope of said portable light where it could catch on or snag an external object.

2. A portable light comprising:

a light body including a light head and a light housing extending from said light head, said light housing defining an envelope line extending along a side thereof away from said light head, said light housing having a recess in the side thereof inward of the envelope line;

a light source supported by said light head and energizable to produce light;

a switch for selectively energizing said light source to produce light; and a clip pivotably disposed in the recess of said light housing, wherein said clip is pivotable on a pivot in the recess of said light housing and is biased to move about the pivot into the recess of said light housing, and wherein the shape and size of the recess and the shape and size of said clip are configured so that said clip is substantially in the recess, wherein said light housing has an internal cavity for receiving plural sources of electrical power, wherein the cavity is configured to receive fewer of the plural sources of electrical power in side by side arrangement in a location adjacent to the recess than at another location in the cavity.

3. The portable light of claim 1 wherein:

said clip is proximate an end of said light housing distal said light head.

4. The portable light of claim 1 wherein: said pivot base supports a pivot pin on which said clip pivots.

5. The portable light of claim 4 wherein the biasing member biases said clip to pivot on said pivot pin towards said light housing.

6. A portable light comprising:

a light body including a light head and a light housing extending from said light head, said light housing defining an envelope line extending along a side thereof away from said light head and a cavity internal to said light housing, said light housing having a recess in the side thereof inward of the envelope line;

a light source supported by said light head and energizable to produce light;

a switch for selectively energizing said light source to produce light; and a clip pivotably disposed in the recess of said light housing, wherein said clip is pivotable on a pivot in the recess of said light housing and is biased to move about the pivot into the recess of said light housing, and wherein the shape and size of the recess and the shape and size of said clip are configured so that said clip is substantially in the recess, and an internal assembly including a battery holder extending into the cavity of said light housing for supporting a plurality of sources of electrical power, wherein said battery holder supports fewer of the plural sources of electrical power in side by side arrangement in a location adjacent to the recess than at another location in the cavity.

7. The portable light of claim 1 wherein said switch includes one or more switch actuators on said light housing, said portable light further comprising an internal assembly including a switch module interior said light housing, said switch module including one or more electrical switches positioned adjacent the one or more switch actuators for being actuated thereby.

8. The portable light of claim 1 wherein said light source includes a first light source supported in said light head, said first light source including a reflector for directing light produced by said first light source outwardly substantially along a central longitudinal axis of said light body.

9. The portable light of claim 8 further comprising a switch actuator on said light body between the light head thereof and said clip, wherein said switch actuator actuates an electrical switch for selectively energizing said first light source.

10. The portable light of claim 8 wherein said light source includes a second light source supported in said light head, said second light source directing light outwardly substantially transversely to the central longitudinal axis of said light body.

11. The portable light of claim 10 further comprising a switch actuator adjacent a lens on a side of said light body through which light from said second light source is directed, wherein said switch actuator actuates an electrical switch for selectively energizing said second light source.

12. The portable light of claim 10 wherein said first light source produces a spot beam and said second light source produces a flood beam.

13. A portable light comprising:

a light body including a light head and a light housing extending from said light head, said light housing defining an envelope line extending along a side thereof away from said light head along the side of said light housing, said light housing having a recess in the side proximate an end thereof distal said light head and inward of the envelope line;

a light source supported by said light head and energizable to produce light;

a switch for selectively energizing said light source to produce light; and a clip pivotably disposed in the recess of said light housing, wherein said clip is pivotable on a pivot that is disposed on a pivot base extending from the recess of said light housing and is biased by a biasing member to move about the pivot on the pivot base into the recess of said light housing, and wherein the shape and size of the recess and the shape and size of said clip are configured so that said clip is in the recess and within the envelope line of said light housing, whereby said clip does not extend beyond the envelope of said portable light where it could catch on or snag an external object.

14. A portable light comprising:

a light body including a light head and a light housing extending from said light head, said light housing defining an envelope line extending along a side thereof away from said light head, said light housing having a recess in the side proximate an end thereof distal said light head and inward of the envelope line;

a light source supported by said light head and energizable to produce light;

a switch for selectively energizing said light source to produce light; and a clip pivotably disposed in the recess of said light housing, wherein said clip is pivotable on a pivot in the recess of said light housing and is biased to move about the pivot into the recess of said light housing, and wherein the shape and size of the recess and the shape and size of said clip are configured so that said clip is substantially in the recess, wherein said light housing has an internal cavity for receiving plural sources of electrical power, wherein the cavity is configured to receive fewer of the plural sources of electrical power in side by side arrangement in a location adjacent to the recess than at another location in the cavity.

15. The portable light of claim 13 wherein: said pivot base supports a pivot pin on which said clip pivots.

16. The portable light of claim 15 wherein the biasing member biases said clip to pivot on said pivot pin towards said light housing.

17. A portable light comprising:

a light body including a light head and a light housing extending from said light head, said light housing defining an envelope line extending along a side thereof away from said light head and defining a cavity internal to said light housing, said light housing having a recess in the side proximate an end thereof distal said light head and inward of the envelope line;

a light source supported by said light head and energizable to produce light;

a switch for selectively energizing said light source to produce light; and a clip pivotably disposed in the recess of said light housing, wherein said clip is pivotable on a pivot in the recess of said light housing and is biased to move about the pivot into the recess of said light housing, and wherein the shape and size of the recess and the shape and size of said clip are configured so that said clip is substantially in the recess, and an internal assembly including a battery holder extending into the cavity of said light housing for supporting a plurality of sources of electrical power, wherein said battery holder supports fewer of the plural sources of electrical power in side by side arrangement in a location adjacent to the recess than at another location in the cavity.

18. The portable light of claim 13 wherein said switch includes one or more switch actuators on said light housing, said portable light further comprising an internal assembly including a switch module interior said light housing, said switch module including one or more electrical switches positioned adjacent the one or more switch actuators for being actuated thereby.

19. The portable light of claim 13 wherein said light source includes a first light source supported in said light head, said first light source including a reflector for directing light produced by said first light source outwardly substantially along a central longitudinal axis of said light body.

20. The portable light of claim 19 further comprising a switch actuator on said light body between the light head thereof and said clip, wherein said switch actuator actuates an electrical switch for selectively energizing said first light source.

21. The portable light of claim 19 wherein said light source includes a second light source supported in said light head, said second light source directing light outwardly substantially transversely to the central longitudinal axis of said light body.

22. The portable light of claim 21 further comprising a switch actuator adjacent a lens on a side of said light body through which light from said second light source is directed, wherein said switch actuator actuates an electrical switch for selectively energizing said second light source.

23. The portable light of claim 21 wherein said first light source produces a spot beam and said second light source produces a flood beam.

24. A portable light comprising:

a light body including a light head and a light housing extending from said light head, said light housing defining an envelope line extending along a side thereof away from said light head along a side of said light housing, said light housing having an internal cavity for receiving plural sources of electrical power, wherein the cavity is configured to receive fewer of the plural sources of electrical power in side by side arrangement in a first location in the cavity than at another location in the cavity, wherein the first location in the cavity is distal the light head;

said light housing having a recess in the side thereof proximate the first location in the cavity thereof distal the light head and inward of the envelope line;

a light source supported by said light head and energizable to produce light;

a switch for selectively energizing said light source to produce light; and a clip pivotably disposed in the recess of said light housing, wherein said clip is pivotable on a pivot that is disposed on said light housing in the recess thereof and is biased to move about the pivot into the recess of said light housing, and wherein the shape and size of the recess and the shape and size of said clip are configured so that said clip is substantially in the recess and substantially within the envelope line of said light housing, whereby said clip does not extend substantially beyond the envelope of said portable light where it could catch on or snag an external object.

25. The portable light of claim 24 wherein:

said clip is proximate an end of said light housing distal said light head.

26. The portable light of claim 24 wherein: said light housing includes a pivot base extending from the recess thereof, said pivot base supporting a pivot pin on which said clip pivots.

27. The portable light of claim 26 further including a biasing member biasing said clip to pivot on said pivot pin towards said light housing.

28. The portable light of claim 24 further comprising:

an internal assembly including a battery holder extending into the cavity of said light housing for supporting a plurality of sources of electrical power, wherein said battery holder supports fewer of the plural sources of electrical power in side by side arrangement in the first location adjacent to the recess.

29. The portable light of claim 24 wherein said light housing includes one or more switch actuators, said portable light further comprising an internal assembly including a switch module interior said light housing, said switch module including one or more electrical switches positioned adjacent the one or more switch actuators for being actuated thereby.

30. The portable light of claim 24 wherein said light source includes a first light source supported in said light head, said first light source including a reflector for directing light produced by said first light source outwardly substantially along a central longitudinal axis of said light body.

31. The portable light of claim 30 further comprising a switch actuator on said light body between the light head thereof and said clip, wherein said switch actuator actuates an electrical switch for selectively energizing said first light source.

32. The portable light of claim 30 wherein said light source includes a second light source supported in said light head, said second light source directing light outwardly substantially transversely to the central longitudinal axis of said light body.

33. The portable light of claim 32 further comprising a switch actuator adjacent a lens on a side of said light body through which light from said second light source is directed, wherein said switch actuator actuates an electrical switch for selectively energizing said second light source.

34. The portable light of claim 32 wherein said first light source produces a spot beam and said second light source produces a flood beam.

35. A portable light comprising:

a light body defining a longitudinal axis and including a light head at a first end thereof and a light housing extending away from said light head;

said light housing having an internal cavity for receiving a source of electrical power and having a non-circular cross-section defining a major dimension and a minor dimension whereat it is graspable by a user, the light body defining first and second sides that are opposite each other in the direction of the major diameter, a first light source supported by said light head and energizable to produce light directed outwardly substantially along said longitudinal axis;

a first actuator for selectively energizing said first light source to produce light, wherein said first actuator is supported on the first side of the light body at a location whereat when a user grasps the light body the first actuator is actuatable by the user's thumb;

a second light source supported by said light head and energizable to produce light directed outwardly substantially transversely to the longitudinal axis through an opening in said light body that is located on the second side of the light body;

a second actuator for selectively energizing said second light source to produce light, wherein said second actuator is supported on said light body on the second side thereof adjacent to the opening in said light body for light produced by said second light source whereat when a user grasps the light body the second actuator is actuatable by a finger other than the user's thumb;

first and second electrical switches in said light body, wherein said first electrical switch is configured to be actuatable by said first actuator and said second electrical switch is configured to be actuatable by said second actuator; and a clip supported on the first side of said light housing in a location that is farther from the first end of said light housing than is said first actuator, wherein said first actuator is supported on said light body substantially diametrically opposite to said second actuator.

36. The portable light of claim 35 wherein said light housing defines an envelope line extending along the first side thereof away from said light head along a side of said light housing, said light housing having a recess in the side thereof inward of the envelope line;

wherein said clip is disposed in the recess of said light housing, wherein the shape and size of the recess and the shape and size of said clip are configured so that said clip is substantially in the recess and substantially within the envelope line of said light housing, whereby said clip does not extend substantially beyond the envelope of said portable light where it could catch on or snag an external object.

37. The portable light of claim 36 wherein:

said clip is pivotable relative to said light housing; or said clip is biased to pivot towards said light housing; or said clip is proximate an end of said light housing distal said light head; or said clip is pivotable relative to said light housing and is biased to pivot towards said light housing; or said clip is proximate an end of said light housing distal said light head, is pivotable relative to said light housing and is biased to pivot towards said light housing.

38. The portable light of claim 36 wherein said source of electrical power includes plural sources of electrical power, and wherein the internal cavity is configured to receive fewer of the plural sources of electrical power in side by side arrangement in a first location in the cavity adjacent the recess than at another location in the cavity.

39. The portable light of claim 35 wherein said first light source produces a spot beam and said second light source produces a flood beam.

40. The portable light of claim 35 wherein said first actuator actuates the first electrical switch for selectively energizing said first light source and said second actuator actuates the second electrical switch for selectively energizing said second light source.

41. The portable light of claim 35 further comprising a lens in the opening in said light body, wherein said second actuator is supported on said light body immediately rearward of said lens.

42. The portable light of claim 1 wherein said light body defines an internal cavity for receiving a source of electrical power selected from the group including a single use battery, an alkaline battery, a rechargeable battery, a nickel-metal-hydride battery, a rechargeable nickel-metal-hydride battery, a lithium-ion battery, and a rechargeable lithium-ion battery.

43. The portable light of claim 13 wherein said light body defines an internal cavity for receiving a source of electrical power selected from the group including a single use battery, an alkaline battery, a rechargeable battery, a nickel-metal-hydride battery, a rechargeable nickel-metal-hydride battery, a lithium-ion battery, and a rechargeable lithium-ion battery.

44. The portable light of claim 24 wherein the plural sources of electrical power are selected from the group including a single use battery, an alkaline battery, a rechargeable battery, a nickel-metal-hydride battery, a rechargeable nickel-metal-hydride battery, a lithium-ion battery, and a rechargeable lithium-ion battery.

45. The portable light of claim 35 wherein the source of electrical power is selected from the group including a single use battery, an alkaline battery, a rechargeable battery, a nickel-metal-hydride battery, a rechargeable nickel-metal-hydride battery, a lithium-ion battery, and a rechargeable lithium-ion battery.

* * * * *